US005127310A

United States Patent [19]

Lishness et al.

[11] Patent Number: 5,127,310

[45] Date of Patent: Jul. 7, 1992

[54] RECOIL SPRING ASSEMBLY FOR A FIREARM

[75] Inventors: Bryant L. Lishness, Bristol; Paul A. Scirica, East Hampton, both of Conn.

[73] Assignee: Colt's Manufacturing Company, Inc., West Hartford, Conn.

[21] Appl. No.: 628,229

[22] Filed: Dec. 14, 1990

[51] Int. Cl.[5] ..... F41A 3/86; F41A 11/00

[52] U.S. Cl. ..... 89/199; 29/1.1; 89/196

[58] Field of Search ..... 29/1.1, 1.11; 89/163, 89/194, 195, 196, 199

[56] References Cited

U.S. PATENT DOCUMENTS

| | | | |
|---|---|---|---|
| 2,115,041 | 4/1938 | Obregon | 89/196 |
| 3,122,061 | 2/1964 | Atchisson | 89/198 |
| 3,731,590 | 5/1973 | Zimmerman, Jr. | 89/163 |
| 3,756,121 | 9/1973 | Roy | 89/196 |
| 4,031,808 | 6/1977 | Raville | 89/163 |
| 4,127,056 | 11/1978 | Kart | 89/128 |
| 4,201,113 | 5/1980 | Seecamp | 89/199 |
| 4,344,352 | 8/1982 | Yates et al. | 89/198 |
| 4,485,723 | 12/1984 | Sarony | 89/163 |
| 4,522,107 | 6/1985 | Woodcock et al. | 89/196 |
| 4,754,689 | 7/1988 | Grehl | 89/196 |
| 5,050,480 | 9/1991 | Knight et al. | 89/163 |

FOREIGN PATENT DOCUMENTS

| | | | |
|---|---|---|---|
| 673028 | 5/1952 | United Kingdom | 89/163 |

*Primary Examiner*—Stephen C. Bentley
*Attorney, Agent, or Firm*—Perman & Green

[57] ABSTRACT

A recoil spring assembly for use with a semi-automatic firearm having a slide. The assembly has an elongate guide, an elongate coil spring mounted over the guide, and an end cap snap locked onto the guide. The assembly also has a washer movably mounted on the guide. The spring is retained on the guide between the end cap and the washer. The guide has a ledge to prevent the washer from being pushed off a first end of the guide by the spring. The assembly can be inserted into and removed from the firearm without risk of the spring becoming dismounted from the guide.

14 Claims, 1 Drawing Sheet

RECOIL SPRING ASSEMBLY FOR A FIREARM

BACKGROUND OF THE INVENTION

1. Field of the Invention

The present invention relates to spring recoil assemblies and, more particularly, to a spring assembly for use in a firearm.

2. Prior Art

U.S. Pat. No. 4,754,689 to Grehl discloses a combination plastic spring guide and buffer assembly for an automatic pistol. The assembly has a metal plate that is connected to a rod segment by a head segment that is snap fitted to the rod segment. U.S. Pat. No. 4,522,107 to Woodcock et al. discloses a shock-absorbing recoil mechanism. U.S. Pat. No. 4,201,113 to Seecamp discloses a telescoping return-spring assembly for an automatic handgun.

A problem exists in the prior art in that no lightweight self-contained spring assembly that is relatively simple to manufacture has been provided.

It is therefore an objective of the present invention to provide a new and improved spring assembly that overcomes problems in the prior art as well as provide additional features.

SUMMARY OF THE INVENTION

The foregoing problems are overcome and other advantages are provided by a new and improved recoil spring assembly for use in a firearm.

In accordance with one embodiment of the present invention, a recoil spring assembly for use in a semi-automatic firearm is provided. The assembly comprises an elongate guide, a first elongate coil spring, an end cap, and means for snap lock connecting the end cap to the guide. The guide has a first end with a ledge and a second end. The coil spring has a center channel with a portion of the guide passing therethrough. The end cap is connected to the guide second end. The means for snap lock connecting can connect the end cap to the guide second end to thereby fixedly connect the end cap to the guide.

In accordance with one method of the present invention, a method of manufacturing a recoil spring assembly for use in a semi-automatic firearm is provided. The method comprises providing an elongate guide, a coil spring, a washer, and an end cap. The elongate guide has a first end with a washer ledge and a second end adapted to snap-lock into connection with the end cap. The method further comprises positioning the washer on the guide adjacent the washer ledge, the washer being movably positioned on the guide, positioning the coil spring on the elongate guide and adjacent the washer, and connecting the end cap to the guide second end by snap-locking a portion of the guide second end with a portion of the end cap such that the coil spring is sandwiched between the washer and the end cap and is prevented from moving off of the guide at the guide ends.

In accordance with another embodiment of the present invention, a recoil spring assembly for use in a semi-automatic firearm for biasing a slide in a forward position is provided. The assembly comprises an elongate guide, a first coil spring, a washer, and an end cap. The elongate guide has a first end adapted to be positioned in a hole of a barrel bushing and a second end having a snap-lock section. The first coil spring has a first end, a second end, and a center channel with a portion of the guide passing therethrough. The washer is movably mounted on the guide with the coil spring first end thereagainst. The end cap has a center passage and an enlarged recess in the center passage. The guide second end is located in the center passage with the snap-lock section being located in the enlarged recess to prevent the end cap from moving relative to the guide such that the coil is sandwiched between the washer and the end cap and can be compressed by movement of the washer relative to the end cap.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
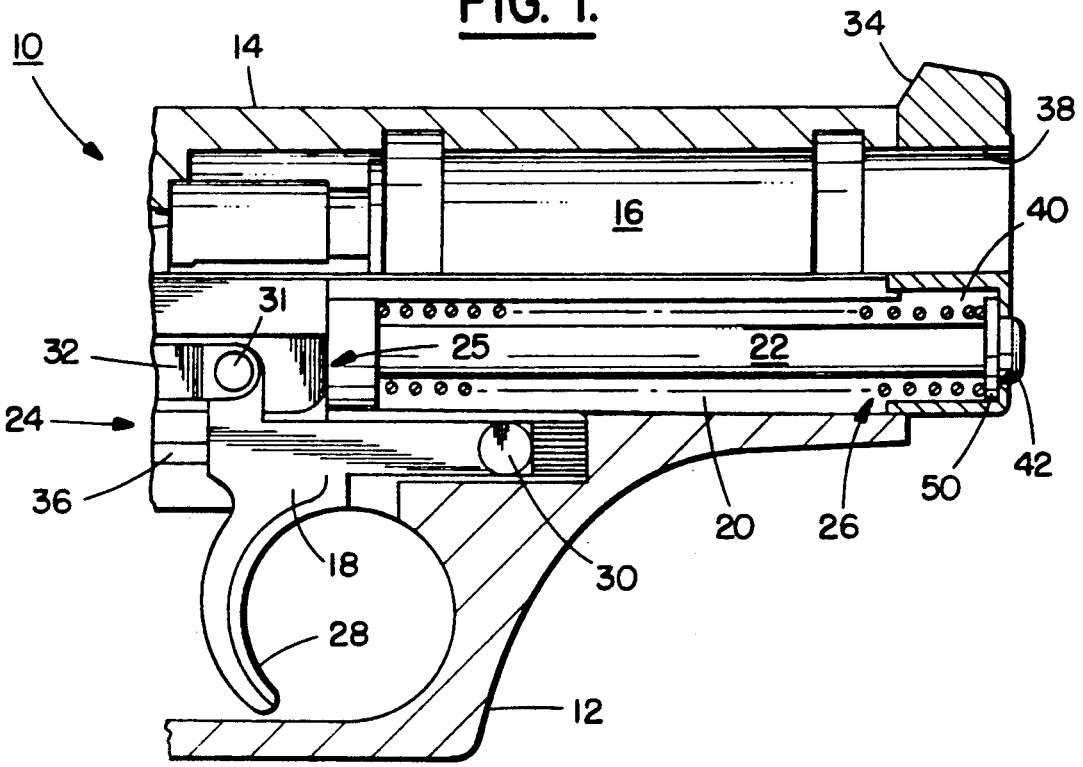
FIG. 1 is a partial schematic cross-sectional view of the front of a pistol incorporating features of the present invention.

Referring to FIG. 1, there is shown a partial schematic cross-sectional view of a semi-automatic pistol 10 having a recoil spring assembly 22 incorporating features of the present invention. Although the present invention will be described with reference to the embodiment shown in the drawings, it should be understood that the present invention can be incorporated into different types of embodiments and may be used with different types of firearms and in conjunction with different features of a firearm. In addition, any suitable size, shape and type of elements or materials could be used.

The pistol 10 generally comprises a frame 12, a slide 14, a barrel 16, a trigger assembly 18, and a firing pin assembly (not shown). The pistol 10 is similar to a pistol disclosed in U.S. patent application Ser. No. 447,601 filed Dec. 8, 1989, now U.S. Pat. No. 5,050,480, which is incorporated by reference in its entirety herein. The frame 12 may be comprised of any suitable material such as metal or plastic. The frame 12 has a trigger cavity 24 and a sear cavity. The trigger assembly 18 comprises a trigger 28, roller bearings 30 and 31, and sear 32. However, any suitable trigger assembly could be provided. The trigger 28 is movably mounted in the trigger cavity 24 for linear longitudinal movement therein supported by roller bearings 30 and 31. A spring and plunger 36 bias the trigger 28 in a forward position. The sear 32 is pivotally connected to the trigger 28 proximate roller bearing 31 and is operably engageable and disengageable with the firing pin assembly to fire a cartridge.

The frame 12 has a recoil spring cavity 20 that partially houses a recoil spring assembly 22. The recoil spring cavity 20, in the embodiment shown, is generally U-shaped with a rear end 25 that is at least partially closed or blocked. The front end 26 of the cavity 20 is substantially open. The slide 14 has a barrel bushing 34 connected to its front end and forming the front sight. The barrel bushing 34 has a barrel bore 38 which allows the bushing 34 to longitudinally move over the barrel 16 during recoil of the slide 14. Located below the barrel bore 38 is a recoil spring assembly recess 40 and a guide aperture 42. In an alternate embodiment of the pistol 10, the barrel bushing 34 may be formed integrally with the slide 14. With the pistol 10 assembled as shown in FIG. 1, a portion of the barrel bushing 34 is located in the recoil spring cavity front end 26 and is suitably sized and shaped to longitudinally slide or move in the cavity 20 as the slide 14 is moved.

Figure 2:
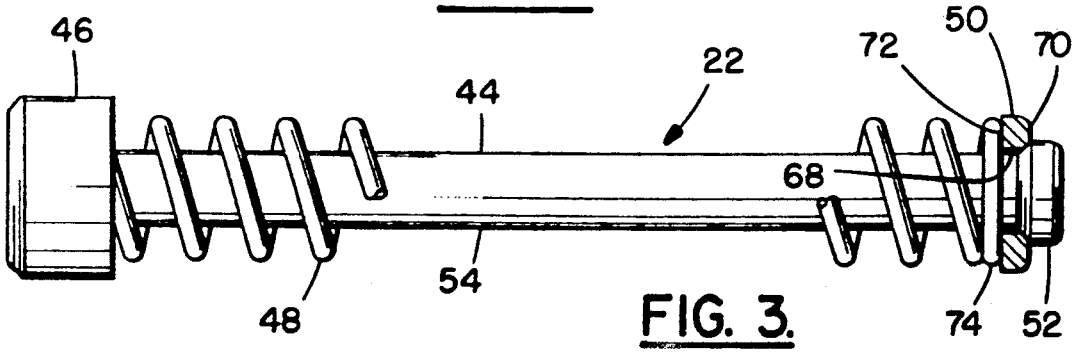
FIG. 2 is a plan side view of a a recoil spring assembly used in the pistol shown in FIG. 1.
Figure 3:
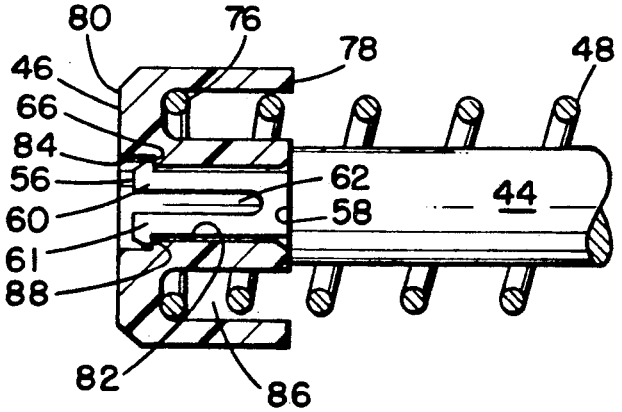
FIG. 3 is a partial cross-sectional view of one end of the assembly shown in FIG. 2
Figure 4:
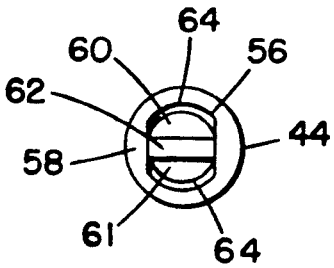
FIG. 4 is a plan end view of the spring guide of the assembly shown in FIG. 2

Referring also to FIGS. 2, 3 and 4, the recoil spring assembly 22, in the embodiment shown, is generally comprised of an elongate guide member 44, an end cap 46, a spring 48 and a washer 50. The assembly 22 has a general elongate shape with the end cap 46 forming its rear end and being positioned adjacent the rear end 25 of the cavity 20. The assembly also has a front end that is located in the guide aperture 42 of the barrel bushing 34.

The guide 44 is a general rod shaped member made of a suitable material such as plastic or a polymer material. However, any suitable type of material can be used including metal. In an alternate embodiment, the guide 44 may also be comprised of a plurality of members connected together. The guide 44 has a front end 52 that forms the front end of the assembly 22. The guide 44 has a middle section 54 of relatively uniform rod-like shape. The guide 44 has a rear end 56 located opposite the front end 52 that forms part of the rear end of the assembly 22. The front end 52 has an enlarged shape relative to the middle section 54 and is suitably sized and shaped to fit inside the guide aperture 42 of the barrel bushing 34. The middle section 54 is suitably sized and shaped to fit inside the spring 48. The rear end 56 has a first ledge 58 and two cantilever legs 60 and 61 with a slot 62 therebetween. The rear tips of the legs 60 and 61 each have a beveled edge 64 and a ledge 66 facing ledge 58.

The washer 50, shown in a cross-sectional view in FIG. 2, is preferably made of metal. However, any suitable material could be used including a plastic or polymer material. The washer 50 has a center hole 68, a front face 70, and a rear face 72. The center hole 68 allows the washer 50 to be movably mounted on the middle section 54 of the guide 44. In the home or rest position shown in FIG. 2, the spring 48 biases the washer 50 against the front end 52 of the guide 44.

The spring 48 is comprised of a single coiled member made of metal. However, any suitable material could be used. In addition, the assembly 22 may, in an alternate embodiment, be comprised of a plurality of coaxial coiled springs mounted over the guide 44 and each other with different directions of coil wind. A front end 74 of the coil 48 is located adjacent the rear face 72 of the washer 50 and, a rear end 76 of the coil 48 is located adjacent the end cap 46. The spring 48 forms an interior channel which allows the spring 48 to compress and expand on the guide 44. The guide 44, in turn, prevents the spring 48 from bending out of its general column shape.

The end cap 46 is preferably made of plastic or a polymer material. However, any suitable material can be used including metal. The end cap 46 has a front end 78, a rear end 80 and a center channel or passage 82 therebetween. The entry to the channel 82 at the front face 78 has a beveled surface. Located at the rear end of the channel 82 the channel has an enlarged recess 84 that forms a lip 88. Projecting into the end cap 46 from the front face 78 is a circular groove 86. The groove 86 is generally intended to house the rear end of the coil spring 48. In the embodiment shown, the length of the end cap 46 therebetween the front face 78 and lip 88 is the same as the length of the legs 60 and 61 between the ledges 66 and the ledge 58.

In order to assemble the assembly 22, the washer 50 is first passed over the guide rear end 56 and moved over the guide middle section 54 to a position adjacent the guide front end 52. The coil spring 48 is then passed over the guide rear end 56 and has its front end 74 contact the washer 50. In the embodiment shown, the coil spring 48 has a natural length longer than the length of the assembly 22. Therefore, the coil spring 48 must be longitudinally compressed in order to connect the end cap 46 to the guide 44. This provides the feature of preloading the spring assembly 22. The connection of the end cap 46 to the guide 44 is the last step to assemble the assembly 22. Once assembled, the spring 48 is compressed between the end cap 46 and the washer 50, both of which are contained by the guide 44 to keep the spring 48 contained on the guide 44.

In order to connect the end cap 46 to the guide 44, the front end 78 of the cap 46 is positioned at the rear end 56 of the guide 44 with the passage 82 aligned at the legs 60 and 61. The end cap 46 is then pressed onto the rear end 56 with the beveled edges 64 of the legs 60 and 61 being wedged inward by the beveled entrance to the passage 82. The slot 62 between the legs 60 and 61 allows the legs to deflect towards each other during insertion. Because the guide 44 is comprised of a resilient deformable material, the deflection of the legs 60 and 61 is not permanent. The legs 60 and 61 are allowed to return to their nondeflected position as described below. The size and profile of the passage 82 is slightly larger or the same as the size and outer profile of the guide rear end 56 between the ledges 66 and ledge 58. As the front face 78 of the cap 46 contacts the ledge 58, the ledges 66 pass into the enlarged recess 84 and snap back to their undeformed position with the ledges 66 coming to rest on the lip 88. With a portion of the cap 46 sandwiched between the ledges 66 and ledge 58, the cap is thus fixedly snap locked onto the rear end 56 of the guide. However, any suitable snap-lock connection could be provided, and the guide rear end 56 and passage 82 could have any suitable shape or configuration.

When the spring assembly 22 is mounted in the pistol 10, the spring assembly 22 biases the barrel bushing 34 in a forward position as shown in FIG. 1. This is generally accomplished by the front face 70 of the washer 50, which is being pushed by the spring 48, being located adjacent the interior surface of the recess 40 and, the end cap 46 being adjacent a portion of the frame 12. When the pistol is fired and the slide 14, with attached barrel bushing 34, moves rearward and the spring 48 is longitudinally compressed. The guide 44 stays in its position with the washer 50 being pushed back on the guide 44 by the barrel bushing 34. The spring assembly 22 absorbs the force of the recoil of the slide 14 and, after the slide 14 has completed its recoil, the spring 48, by pushing on the washer 50 which pushes on the barrel bushing 34, returns the slide 14 and barrel bushing 34 back to its normal battery position shown in FIG. 1.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A recoil spring assembly for use in a semi-automatic firearm, the assembly comprising:

an elongate guide having a first end with a ledge and a second end;

at least one elongate coil spring having a center channel with a portion of said guide passing therethrough;

an end cap connected to said guide second end, said end cap having an aperture into which a portion of said guide second end is positioned; and means for snap lock connecting said end cap to said guide second end to thereby fixedly connect said end cap to said guide.

2. An assembly as in claim 1 wherein said guide is comprised of a polymer material.

3. An assembly as in claim 1 wherein said means for snap locking connecting comprises said guide second end having at least two cantilever sections that deflect and substantially snap back to a home position during connection of said end cap thereto.

4. An assembly as in claim 3 wherein said guide second end has a ledge to position a portion of said end cap thereagainst.

5. An assembly as in claim 4 wherein said cantilever sections each comprise a ledge to contact a portion of said end cap and substantially sandwich a portion of said end cap between said cantilever sections ledges and said second end ledge.

6. An assembly as in claim 5 wherein said cantilever sections each comprise a ramp surface in front of its cantilever section ledge.

7. An assembly as in claim 1 wherein said end cap aperture comprises an enlarged area into which a portion of said guide second end snaps into.

8. An assembly as in claim 1 wherein said end cap has a recess for positioning an end of said coil spring thereinto.

9. An assembly as in claim 1 further comprising a washer movably mounted on said guide and adapted to push an end of said coil spring.

10. A method of manufacturing a recoil spring assembly for use in a semi-automatic firearm, the method comprising:

providing an elongate guide, a coil spring, a washer, and an end cap, the elongate guide having a first end with a washer ledge, and a second end adapted to snap lock into connection with the end cap;

positioning the washer on the guide adjacent the washer ledge, the washer being movably positioned on the guide;

positioning the coil spring on the elongate guide and adjacent the washer; and connecting the end cap to the guide second end by snap locking a portion of the guide second end with a portion of the end cap such that the coil spring is sandwiched between the washer and the end cap and is prevented from moving off of the guide at the guide ends wherein the step of connecting comprises inserting the guide second end into an aperture in the end cap with the guide second end being compressed in a first section of the aperture and then being allowed to expand in a second section of the aperture to thereby snap lock the guide and end cap together.

11. A recoil spring assembly for use in a semi-automatic firearm for biasing a slide in a forward position, the assembly comprising:

an elongate guide having a first end adapted to be positioned in a hole of a barrel bushing and a second end having a snap lock section;

a first coil spring having a first end, a second end, and a center channel with a portion of said guide passing therethrough;

a washer movably mounted on said guide with said coil spring first end thereagainst; and an end cap having a center passage and an enlarged recess in said center passage, said guide second end being located in said center passage with said snap lock section being located in said enlarged recess to prevent said end cap from moving relative to said guide such that said coil is sandwiched between said washer and said end cap and can be compressed by movement of said washer relative to said end cap.

12. An assembly as in claim 11 wherein said guide is comprised of a polymer material.

13. An assembly as in claim 11 wherein said guide snap lock section comprises at least two cantilevered legs with portions that are deformed by said end cap center passage and snap into said enlarged recess.

14. An assembly as in claim 13 wherein said guide second end comprises a ledge at a base of said legs for said end cap to rest thereagainst.

* * * * *